US007416390B2

(12) United States Patent
Liang

(10) Patent No.: US 7,416,390 B2
(45) Date of Patent: Aug. 26, 2008

(54) TURBINE BLADE LEADING EDGE COOLING SYSTEM

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 568 days.

(21) Appl. No.: 11/092,792

(22) Filed: Mar. 29, 2005

(65) Prior Publication Data

US 2006/0222494 A1 Oct. 5, 2006

(51) Int. Cl.
*F01D 5/18* (2006.01)

(52) U.S. Cl. ..... 416/97 R

(58) Field of Classification Search ..... 416/97 R, 416/96 A

See application file for complete search history.

(56) References Cited

U.S. PATENT DOCUMENTS

| | | | | |
|---|---|---|---|---|
| 3,191,908 | A * | 6/1965 | Powell et al. | 416/96 R |
| 4,183,716 | A | 1/1980 | Takahara et al. | |
| 4,595,298 | A | 6/1986 | Frederick | |
| 4,770,608 | A | 9/1988 | Anderson et al. | |
| 5,624,231 | A | 4/1997 | Ohtomo et al. | |
| 5,667,359 | A | 9/1997 | Huber et al. | |
| 5,720,431 | A | 2/1998 | Sellers et al. | |
| 5,813,835 | A | 9/1998 | Corsmeier et al. | |
| 6,036,441 | A | 3/2000 | Manning et al. | |
| 6,174,134 | B1 | 1/2001 | Lee et al. | |
| 6,183,192 | B1 | 2/2001 | Tressler et al. | |
| 6,206,638 | B1 | 3/2001 | Glynn et al. | |
| 6,290,463 | B1 | 9/2001 | Fargher et al. | |
| 2002/0119045 | A1 | 8/2002 | Starkweather | |

FOREIGN PATENT DOCUMENTS

| | | |
|---|---|---|
| EP | 0416542 A1 | 3/1991 |
| EP | 1008724 A2 | 6/2000 |

* cited by examiner

*Primary Examiner*—Richard Edgar

(57) ABSTRACT

A cooling system for a turbine blade of a turbine engine having a leading edge impingement cooling channel in series with one or more pressure and suction side impingement cooling channels. The turbine blade may include a double outer wall with impingement cooling channels positioned between the walls. The impingement cooling channels may be adapted to match heat localized loads and hot side gas pressures across the turbine blade to maximize the efficiency of the cooling system.

16 Claims, 2 Drawing Sheets

TURBINE BLADE LEADING EDGE COOLING SYSTEM

FIELD OF THE INVENTION

This invention is directed generally to turbine blades, and more particularly to cooling systems in hollow turbine blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The inner aspects of most turbine blades typically contain an intricate maze of cooling channels forming a cooling system. The cooling channels in the blade receive air from the compressor of the turbine engine and pass the air through the blade. The cooling channels often include multiple flow paths that are designed to maintain all aspects of the turbine blade at a relatively uniform temperature. Localized hot spots, depending on their location, can reduce the useful life of a turbine blade and can damage a turbine blade to an extent necessitating replacement of the blade. Typically, the leading edge of the turbine blade is subjected to the greatest heat loads relative to other portions of the blade. The heat load at the leading edge creates challenges in cooling the leading edge sufficiently while efficiently cooling remaining internal portions and outer surfaces of the turbine blade with minimal waste. Thus, a need exists for an efficient turbine blade cooling system.

SUMMARY OF THE INVENTION

This invention relates to a turbine blade cooling system for a turbine blade usable in a turbine engine. The cooling system may include a leading edge impingement cooling channel extending spanwise along the leading edge of the turbine blade configured to allow cooling fluids to impinge on an inner surface of an outer wall forming the leading edge. The cooling system may also include a plurality of impingement cooling channels on the pressure side and suction side of the turbine blade between the inner and outer walls forming a double outer wall of the turbine blade. The impingement cooling channels may be configured to efficiently meet the cooling fluids flow requirements dictated by localized heat loads on the turbine blade.

The turbine blade may be formed from a generally elongated blade having a leading edge, a trailing edge, a tip section at a first end, a root coupled to the blade at an end generally opposite the first end for supporting the blade and for coupling the blade to a disc, and at least one cavity forming a cooling system in the blade. The generally elongated blade may be formed from at least one outer wall and at least one inner wall, whereby the at least one inner wall and the at least one outer wall are separated by at least one outer wall cavity. An airfoil core cooling chamber may be positioned in the generally elongated blade and defined by the inner wall.

The at least one outer wall cavity may include at least one leading edge impingement cooling channel positioned in close proximity to the leading edge of the generally elongated blade and formed from a first suction side rib extending spanwise and a first pressure side rib extending spanwise. The leading edge impingement cooling channel may receive cooling fluids through at least one impingement orifice in the inner wall creating a cooling fluid pathway for cooling fluids to impinge on an inner surface of the outer wall at the leading edge of the generally elongated blade.

The cooling system may also include one or more suction side impingement chambers positioned in the at least one cavity and in close proximity to the at least one leading edge impingement cooling channel and the suction side of the generally elongated blade. The suction side impingement chambers may be positioned between the inner and outer walls and in communication with the at least one leading edge impingement cooling channel. In at least one embodiment, the cooling system may include two or more suction side impingement chambers coupled together in series with at least one impingement orifice. One or more impingement orifices may be positioned in the first suction side rib for directing cooling fluids into a first suction side impingement chamber.

The cooling system may also include one or more pressure side impingement chambers positioned in the at least one cavity and in close proximity to the at least one leading edge impingement cooling channel and the pressure side of the generally elongated blade. The pressure side impingement chambers may be positioned between the inner and outer walls and in communication with the at least one leading edge impingement cooling channel. In at least one embodiment, the cooling system may include two or more pressure side impingement chambers coupled together in series with at least one impingement orifice. One or more impingement orifices may be positioned in the first pressure side rib for directing cooling fluids into a first pressure side impingement chamber.

The cooling system may include a pressure side mid-chord cooling channel positioned between the inner and outer walls on the pressure side of the generally elongated blade proximate to the pressure side impingement chambers. One or more impingement orifices may provide a cooling fluid pathway between the airfoil core cooling chamber and the pressure side mid-chord cooling channel. Similarly, the cooling system may include a suction side mid-chord cooling channel positioned between the inner and outer walls on the suction side of the generally elongated blade proximate to the suction side impingement chambers. One or more impingement orifices may provide a cooling fluid pathway between the airfoil core cooling chamber and the pressure side mid-chord cooling channel.

The cooling system may include a trailing edge cooling chamber formed from at least one cooling fluid supply chamber and at least one trailing edge impingement cooling chamber extending spanwise along the trailing edge of the turbine blade and separated from the cooling fluid supply chamber by a rib containing at least one impingement orifice. The trailing edge cooling chamber may also include a plurality of trailing edge cooling chambers that extend spanwise along the trailing edge of the generally elongated blade and that are coupled together in series with at least one impingement orifice in ribs separating the trailing edge cooling chambers.

During use, cooling fluids flow into the airfoil core cooling chamber and into the leading edge impingement cooling channel, the suction side and pressure side impingement chambers, and the suction side and pressure side mid-chord cooling channels. The cooling fluids pass through impingement orifices and impinge on inner surfaces of the cooling channels. The cooling fluids may be passed into other cooling channels downstream of the channels through impingement orifices in ribs between the inner and outer walls creating cooling fluid pathways. The cooling fluids may be exhausted from the cooling channels through exhaust orifices that are arranged based on factors, such as, but not limited to, localized heat loads, gas side pressure distribution, or other factors.

An advantage of the invention is that the cooling system enables leading edge cooling flow and pressure to be regulated in spanwise and chordwise directions.

Another advantage of the invention is that the cooling system is capable of efficiently cooling the leading edge of the blade and other areas with less heat load than the leading edge.

Yet another advantage of the invention is that the exhaust orifices in the leading edge forming a showerhead are maximized, thereby resulting in increased leading edge film cooling coverage and lower leading edge metal temperature.

Another advantage of the invention is that the number of exhaust orifices in the leading edge may be increased, which enhances the overall leading edge internal convection cooling capability and reduces the temperature of the leading edge.

Still another advantage of the invention is that the cooling system's double use of cooling fluids to impinge on an inner surface of the leading edge and as impingement cooling fluids downstream of the leading edge in close proximity to the outer surface of the turbine blade increases the efficiency of the cooling system.

Another advantage of this invention is that the effectiveness of the cooling system is enhanced by positioning the impingement channels in close proximity to outer surfaces of the turbine blade at the leading edge and mid-chord region.

Yet another advantage of this invention is that the impingement cooling channels may be configured for localized areas of the turbine blade enabling the pressure ratio, also referred to as the blowing ratio, at the film cooling holes to be reduced to minimize cooling fluid penetration into the gas path. By minimizing cooling fluid penetration, a film cooling layer may build up on the outer surface of the turbine blade resulting in higher leading edge film cooling effectiveness and a lower temperature of the turbine blade.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
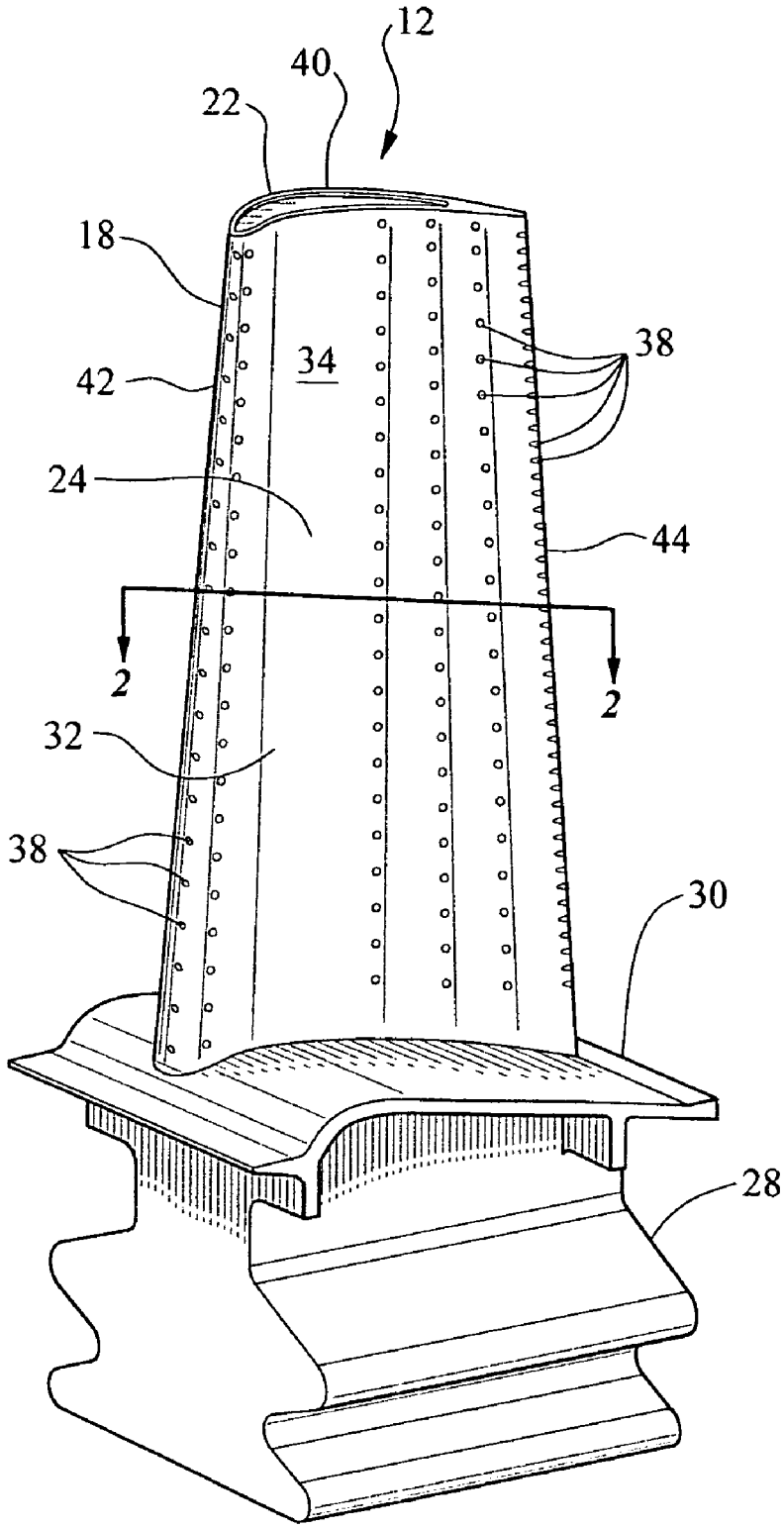
FIG. 1 is a perspective view of a turbine blade having features according to the instant invention.
Figure 2:
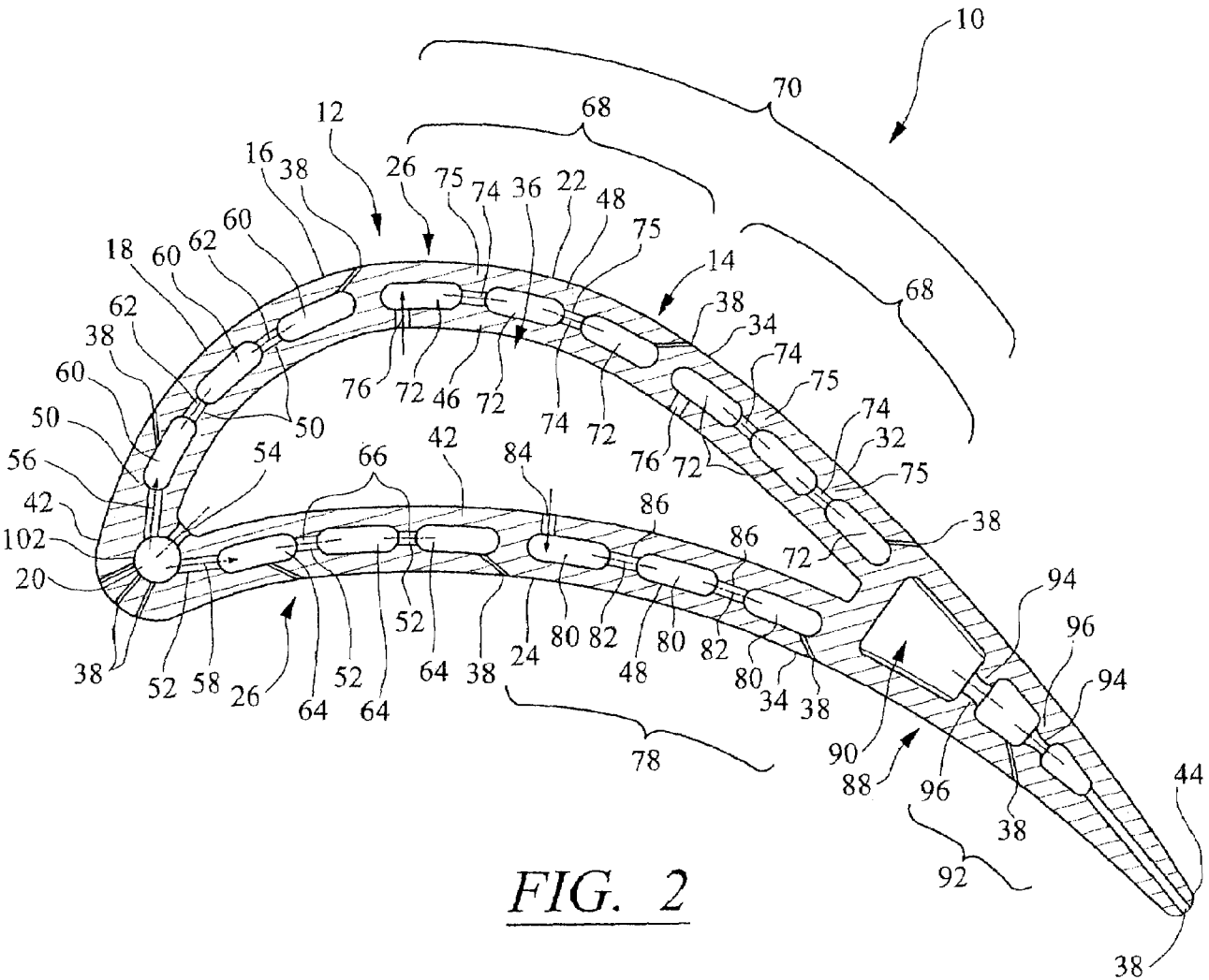
FIG. 2 is cross-sectional view of the turbine blade shown in FIG. 1 taken along line 2-2.

As shown in FIGS. 1-2, this invention is directed to a turbine blade cooling system 10 for turbine blades 12 used in turbine engines. In particular, turbine blade cooling system 10 is directed to a cooling system located in a cavity 14, as shown in FIG. 2, positioned between two or more walls 16 forming a housing 18 of the turbine blade 12. The turbine blade cooling system 10 includes a leading edge impingement cooling channel 20 that is cooled with a plurality of impingement orifices 54 and includes a plurality of suction side 22 and pressure side 24 impingement cooling channels 26 between the walls 16 that are coupled together in series with impingement orifices for reducing the temperature of the turbine blade 12. The impingement cooling channels 26 enable the cooling system 10 to be configured to supply cooling fluids at various pressures and flow rates based upon gas side discharge pressure in both chordwise and spanwise directions on the turbine blade 12.

As shown in FIG. 1, the turbine blade 12 may be formed from a root 28 having a platform 30 and a generally elongated blade 32 coupled to the root 28 at the platform 30. Blade 32 may have an outer surface 34 adapted for use, for example, in a first stage of an axial flow turbine engine. Outer surface 34 may be formed from the housing 18 having a generally concave shaped portion forming pressure side 24 and may have a generally convex shaped portion forming suction side 22. The blade 32 may include one or more main airfoil core cooling chambers 36 positioned in inner aspects of the blade 32 for directing one or more gases, which may include air received from a compressor (not shown), through the blade 32 and eventually out of one or more exhaust orifices 38 in the blade 32. As shown in FIG. 1, the exhaust orifices 38 may be positioned in a tip 40, a leading edge 42, a trailing edge 44, or outer surface 34, or any combination thereof, and have various configurations for exhausting cooling fluids from the blade 32 to create a boundary layer of cooling fluids for film cooling.

As previously mentioned, the housing 18 may be composed of two or more walls 16. As shown in FIG. 2, the housing 18 may be formed from an inner wall 46 and an outer wall 48. The inner wall 46 may be configured to generally follow the contours of the outer wall 48 yet be spaced from the outer wall 48 to form the cavity 14 between the inner and outer walls 46, 48. The leading edge impingement cooling channel 20 may be positioned between the inner and outer walls 46, 48 and formed by a suction side rib 50 and a pressure side rib 52. The suction side and pressure side ribs 50, 52 may extend generally spanwise in the blade 32 in the cavity 14. The leading edge impingement cooling channel 20 may extend generally spanwise along the leading edge 42 of the elongated blade 32. The leading edge impingement cooling channel 20 may receive cooling fluids from the airfoil core cooling chamber 36 through one or more leading edge impingement orifices 54 positioned in the inner wall 46. The leading edge impingement cooling channel 20 provides a cooling fluid pathway between the airfoil core cooling chamber 36 and the leading edge cooling chamber 20. In at least one embodiment, the inner wall 46 may include a plurality of leading edge impingement orifices 54. The leading edge impingement cooling channel may also include a plurality of exhaust orifices 38 forming a showerhead for creating a cooling fluid boundary proximate to the outer surface 34 of the generally elongated blade 32.

The cooling system 10 may also include one or more impingement orifices 56 in the suction side rib 50 and may include one or more impingement orifices 58 in the pressure side rib 52. The impingement orifices 56, 58 form a cooling fluid pathway through the ribs 50, 52 so that cooling fluids may impinge on downstream surfaces, thereby increasing the heat transfer and cooling capabilities of the cooling system 12. The number, size, and cross-sectional area of the impingement orifices 56, 58 may be determined based upon the gas side discharge pressure, heat load, or other factors so as to maximize formation of a film cooling layer proximate to the outer surface 34 of the generally elongated blade 32.

The cooling system 10 may also include one or more suction side impingement chambers 60 positioned between inner and outer walls 46, 48 proximate to the leading edge impingement cooling channel 20 and to the suction side 22 of the blade 32. In at least one embodiment, there may be two or three suction side impingement chambers 60 positioned in series in the cavity 14, wherein each suction side impingement chamber 60 is in communication with the adjacent chamber 60 through an impingement orifice 62. The suction side impingement chambers 60 may extend spanwise generally along the elongated blade 32. A single suction side impingement chamber 60 may extend from the root 28 to the tip 40, or the suction side impingement chamber 60 may be divided into two or more channels in parallel extending spanwise between the root 28 and the tip 40. The cooling fluids in the suction side impingement chambers 60 may be exhausted through one or more exhaust orifices 38 for film cooling applications.

The cooling system 10 may also include one or more pressure side impingement chambers 64 positioned between the inner and outer walls 46, 48 proximate to the leading edge impingement cooling channel 20 and to the pressure side 24 of the blade 32. In at least one embodiment, there may be two or three pressure side impingement chambers 64 positioned in series in the cavity 14, wherein each pressure side impingement chamber 64 is in communication with the adjacent chamber 64 through an impingement orifice 66. The pressure side impingement chambers 64 may extend spanwise generally along the elongated blade 32. A single pressure side impingement chambers 64 may extend from the root 28 to the tip 40, or the pressure side impingement chambers 64 may be divided into two or more channels in parallel extending spanwise between the root 28 and the tip 40. The cooling fluids in the pressure side impingement chambers 64 may be exhausted through one or more exhaust orifices 38 for film cooling applications.

The airfoil core cooling chamber 36 may be formed from one or more chambers. For instance, as shown in FIG. 2, the airfoil core cooling chamber 36 may form a single cooling chamber defined by the inner wall 46 that extend through root 16 and blade 32. In particular, the airfoil core cooling chamber 36 may extend spanwise from the tip 36 to the root 16 and chordwise from the leading edge 42 to the trailing edge 44. Alternatively, the airfoil core cooling chamber 36 may be formed only in portions of the root 16 and the blade 32. The airfoil core cooling chamber 36 may be configured to receive a cooling gas, such as air, from the compressor (not shown). The airfoil core cooling chamber 36 is not limited to the configuration shown in FIG. 2, but may have other configurations as well.

The cooling system 10 may also include one or more suction side mid-chord cooling channels 68 positioned in a mid-chord region 70 of the blade 32 between the inner and outer walls 46, 48. In at least one embodiment, as shown in FIG. 2, the cooling system 10 may include two suction side mid-chord cooling channels 68. The suction side mid-chord cooling channel 68 may be formed from one or more one or more elongated cooling channels 72 extending generally spanwise in the blade 32. In at least one embodiment, the suction side mid-chord cooling channel 68 may be formed from a plurality of elongated cooling channels 72 coupled together in series through one or more impingement orifices 74 positioned in ribs 75. In at least one embodiment, each rib 75 may include at least one impingement orifice 74. In at least one embodiment, a plurality of impingement orifices 74 may extend spanwise between adjacent suction side mid-chord cooling channels 68 in ribs 75. Cooling fluids may be admitted into the suction side mid-chord cooling channels 68 through one or more impingement orifices 76 positioned in the inner wall 46. Cooling fluids may be exhausted from the suction side mid-chord cooling channels 68 through one or more exhaust orifices 38. The exhaust orifices 38 may be positioned in the outer surface 34 based upon the gas side discharge pressure, heat loads, or other factors, or any combination thereof.

The cooling system 10 may also include one or more pressure side mid-chord cooling channels 78 positioned in the mid-chord region 70 of the blade 32 between the inner and outer walls 46, 48. The pressure side mid-chord cooling channel 78 may be formed from one or more one or more elongated cooling channels 80 extending generally spanwise in the blade 32. In at least one embodiment, the pressure side mid-chord cooling channel 78 may be formed from a plurality of elongated cooling channels 80 coupled together in series through one or more impingement orifices 82 in ribs 86. In at least one embodiment, each rib 86 may include at least one impingement orifice 82. In at least one embodiment, a plurality of impingement orifices 82 may extend spanwise between adjacent pressure side mid-chord cooling channels 78 in ribs 86. Cooling fluids may be admitted into the pressure side mid-chord cooling channels 78 through one or more impingement orifices 84 positioned in the inner wall 46. Cooling fluids may be exhausted from the pressure side mid-chord cooling channels 78 through one or more exhaust orifices 38. The exhaust orifices 38 may be positioned in the outer surface 34 based upon the gas side discharge pressure, heat loads, or other factors, or any combination thereof.

The cooling system 10 may include a trailing edge cooling chamber 88 for cooling portions of the generally elongated blade 32 proximate to the trailing edge 44. In at least one embodiment, the trailing edge cooling chamber 88 may include one or more cooling fluid supply chambers 90. The trailing edge cooling chamber 88 may also include one or more trailing edge impingement cooling chambers 92 extending spanwise along the trailing edge 44 of the blade 32. The trailing edge cooling chamber 88 may be coupled to the cooling fluid supply chamber 90 through one or more impingement orifices 94. The trailing edge cooling chambers 92 may be coupled together in series forming a cooling fluid pathway with one or more impingement orifices 94 in rib 96 separating the chambers 92. Exhaust orifices 38 may be in communication with the trailing edge cooling chamber 88 to exhaust cooling fluids from the cooling chamber 88.

During use, cooling fluids may be passed into the cooling system 12 from a cooling fluid source, such as, but not limited to, a compressor, and through the root 28. The cooling fluids may enter the cooling system 12 by flowing through an inlet in a wall forming a portion of the root 28 from the elongated blade 32. The cooling fluids flow through the inlet into the airfoil core cooling chamber 36 that is defined by the inner wall 46. The cooling fluids then enter into the leading edge impingement cooling channel 20, the suction side and pressure side impingement chambers 60, 64, and the suction side and pressure side mid-chord cooling channels 68, 78 by passing through impingement orifices 54, 62, 66, 76, and 84. The cooling fluids entering the leading edge impingement cooling channel 20 pass through the leading edge impingement orifices 54 and impinge on an inner surface 102 of the leading edge 42. At least a portion of the cooling fluids are exhausted from the leading edge impingement cooling channel 20 through exhaust orifices 38 that form a showerhead in the leading edge 42. The remaining cooling fluids pass through either the impingement orifice 56 in the suction side rib 50 or through the impingement orifice 58 in the pressure side rib 52. The cooling fluids impinge on the walls forming the suction side and pressure side impingement chambers 60, 64, respectively. The cooling fluids flow through the plurality of suction side and pressure side impingement chambers 60, 64. The cooling fluids may be exhausted from the suction side and pressure side impingement chambers 60, 64 through exhaust orifices 38.

Cooling fluids may also enter the suction side and pressure side mid-chord cooling channels 60, 64 through impingement orifices 76, 84. The cooling fluids may impinge on the outer wall 48 of the suction side and pressure side 22, 24, respectively. The cooling fluids may flow through the elongated channels 72, 80 forming the suction side and pressure side mid-chord cooling channels 60, 64, respectively and be exhausted through exhaust orifices 38. The exhausted cooling fluids may form a film cooling layer on the outer surface 34 of the turbine blade 12.

Cooling fluids may enter the trailing edge cooling channel 88 and collect in the cooling fluid supply chamber 90. The cooling fluids may pass into the trailing edge impingement cooling channels 92 through impingement orifices 94 in ribs 96. The cooling fluids may impinge on surfaces forming the trailing edge impingement cooling channels 92. The cooling fluids may be exhausted from the trailing edge impingement cooling channels 92 through the exhaust orifices 38 in the trailing edge 44.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, a tip section at a first end, a root coupled to the blade at an end generally opposite the first end for supporting the blade and for coupling the blade to a disc, and at least one cavity forming a cooling system in the blade;

the generally elongated blade formed from at least one outer wall and at least one inner wall, whereby the at least one inner wall and the at least one outer wall are separated by the at least one cavity forming the cooling system;

an airfoil core cooling chamber in the generally elongated blade that is defined by the inner wall;

at least one leading edge impingement cooling channel positioned in the at least one cavity and in close proximity to the leading edge of the generally elongated blade and formed from a first suction side rib extending spanwise and a first pressure side rib extending spanwise;

at least one first suction side impingement chamber positioned in the at least one cavity and in close proximity to the at least one leading edge impingement cooling channel and a suction side of the generally elongated blade;

at least one first pressure side impingement chamber positioned in the at least one cavity and in close proximity to the at least one leading edge impingement cooling channel and a pressure side of the generally elongated blade;

at least one impingement orifice in the inner wall creating a cooling fluid pathway for cooling fluids to impinge on an inner surface of the outer wall at the leading edge of the generally elongated blade;

at least one impingement orifice in the first suction side rib for directing cooling fluids into the first suction side impingement chamber;

a second suction side impingement chamber in communication with the first suction side impingement chamber and separated from the first suction side impingement chamber by at least one second suction side rib with at least one impingement orifice;

a third suction side impingement chamber in communication with the second suction side impingement chamber and separated from the second suction side impingement chamber by at least one third suction side rib having at least one impingement orifice;

at least one impingement orifice in the first pressure side rib for directing cooling fluids into the first pressure side impingement chamber;

a second pressure side impingement chamber in communication with the first pressure side impingement chamber and separated from the first pressure side impingement chamber by at least one second pressure side rib with at least one impingement orifice;

a third pressure side impingement chamber in communication with the second pressure side impingement chamber and separated from the second pressure side impingement chamber by at least one third pressure side rib having at least one impingement orifice;

at least two suction side mid-chord cooling channels positioned between the inner and outer walls on the suction side of the generally elongated blade, wherein each suction side mid-chord cooling channel comprises a plurality of elongated cooling channels in series with each other, wherein each elongated cooling channel is separated by a rib containing at least one impingement orifice, and wherein at least one impingement orifice provides a cooling fluid pathway between the airfoil core cooling chamber and each of the at least two suction side mid-chord cooling channels.

2. The turbine blade of claim 1, further comprising a pressure side mid-chord cooling channel positioned between the inner and outer walls on the pressure side of the generally elongated blade, wherein at least one impingement orifice provides a cooling fluid pathway between the airfoil core cooling chamber and the pressure side mid-chord cooling channel.

3. The turbine blade of claim 2, wherein the pressure side mid-chord cooling channel comprises at least three elongated cooling channels in series with each other, wherein each elongated cooling channel is separated by a rib containing at least one impingement orifice.

4. The turbine blade of claim 1, wherein each of the suction side mid-chord cooling channels comprises at least three elongated cooling channels in series with each other, wherein each elongated cooling channel is separated by a rib containing at least one impingement orifice.

5. The turbine blade of claim 1, further comprising a trailing edge cooling chamber formed from at least one cooling fluid supply chamber and at least one trailing edge impingement cooling chamber extending spanwise along the trailing edge and separated from the cooling fluid supply chamber by a rib containing at least one impingement orifice.

6. The turbine blade of claim 5, wherein the at least one trailing edge impingement cooling chamber comprises a plurality of trailing edge cooling chambers that extend spanwise along the trailing edge of the generally elongated blade and that are coupled together in series with at least one impingement orifice in ribs separating the trailing edge cooling chambers.

7. A turbine blade, comprising:

a generally elongated blade having a leading edge, a trailing edge, a tip section at a first end, a root coupled to the blade at an end generally opposite the first end for supporting the blade and for coupling the blade to a disc, and at least one cavity forming a cooling system in the blade;

the generally elongated blade formed from at least one outer wall and at least one inner wall, whereby the at least one inner wall and the at least one outer wall are separated by the at least one cavity forming the cooling system;

an airfoil core cooling chamber in the generally elongated blade that is defined by the inner wall;

at least one leading edge impingement cooling channel positioned in the at least one cavity and in close proximity to the leading edge of the generally elongated blade and formed from a first suction side rib extending spanwise and a first pressure side rib extending spanwise;

at least one impingement orifice in the inner wall creating a cooling fluid pathway for cooling fluids to impinge on an inner surface of the outer wall at the leading edge of the generally elongated blade;

at least two suction side impingement chambers positioned between the inner and outer walls, coupled together in series with at least one impingement orifice, and in communication with the at least one leading edge impingement cooling channel through at least one impingement orifice in the first suction side rib for directing cooling fluids into a first suction side impingement chamber of the at least two suction side impingement chambers; and at least two pressure side impingement chambers positioned between the inner and outer walls, coupled together in series with at least one impingement orifice, and in communication with the at least one leading edge impingement cooling channel through at least one impingement orifice in the first pressure side rib for directing cooling fluids into a first pressure side impingement chamber of the at least two pressure side impingement chambers;

at least two suction side mid-chord cooling channels positioned between the inner and outer walls on the suction side of the generally elongated blade, wherein each suction side mid-chord cooling channel comprises a plurality of elongated cooling channels in series with each other, wherein each elongated cooling channel is separated by a rib containing at least one impingement orifice, and wherein at least one impingement orifice provides a cooling fluid pathway between the airfoil core cooling chamber and each of the at least two suction side mid-chord cooling channels.

8. The turbine blade of claim 7, further comprising a pressure side mid-chord cooling channel positioned between the inner and outer walls on the pressure side of the generally elongated blade proximate to the at least two pressure side impingement chambers, wherein at least one impingement orifice provides a cooling fluid pathway between the airfoil core cooling chamber and the pressure side mid-chord cooling channel.

9. The turbine blade of claim 8, wherein the pressure side mid-chord cooling channel comprises at least three elongated cooling channels in series with each other, wherein each cooling channel is separated by a rib containing at least one impingement orifice.

10. The turbine blade of claim 8, wherein each of the suction side mid-chord cooling channels comprises at least three elongated cooling channels in series with each other, wherein each cooling channel is separated by a rib containing at least one impingement orifice.

11. The turbine blade of claim 7, further comprising a trailing edge cooling chamber formed from at least one cooling fluid supply chamber and at least one trailing edge impingement cooling chamber extending spanwise along the trailing edge and separated from the cooling fluid supply chamber by a rib containing at least one impingement orifice.

12. The turbine blade of claim 11, wherein the at least one trailing edge impingement cooling chamber comprises a plurality of trailing edge cooling chambers that extend spanwise along the trailing edge of the generally elongated blade and that are coupled together in series with at least one impingement orifice in ribs separating the trailing edge cooling chambers.

13. A turbine blade, comprising:

a generally elongated blade having a leading edge, a trailing edge, a tip section at a first end, a root coupled to the blade at an end generally opposite the first end for supporting the blade and for coupling the blade to a disc, and at least one cavity forming a cooling system in the blade;

the generally elongated blade formed from at least one outer wall and at least one inner wall, whereby the at least one inner wall and the at least one outer wall are separated by the at least one cavity forming the cooling system;

an airfoil core cooling chamber in the generally elongated blade that is defined by the inner wall;

at least one leading edge impingement cooling channel positioned in the at least one cavity and in close proximity to the leading edge of the generally elongated blade and formed from a first suction side rib extending spanwise and having at least one impingement orifice and a first pressure side rib extending spanwise and having at least one impingement orifice;

at least one impingement orifice in the inner wall creating a cooling fluid pathway for cooling fluids to impinge on an inner surface of the outer wall at the leading edge of the generally elongated blade;

at least two suction side impingement chambers positioned between the inner and outer walls, coupled together in series with at least one impingement orifice, and in communication with the at least one leading edge impingement cooling channel through the at least one impingement orifice in the first suction side rib for directing cooling fluids into a first suction side impingement chamber of the at least two suction side impingement chambers;

at least two pressure side impingement chambers positioned between the inner and outer walls, coupled together in series with at least one impingement orifice, and in communication with the at least one leading edge impingement cooling channel through the at least one impingement orifice in the first pressure side rib for directing cooling fluids into a first pressure side impingement chamber of the at least two pressure side impingement chambers;

a pressure side mid-chord cooling channel formed from a plurality of elongated channels coupled together in series with impingement orifices and positioned between the inner and outer walls on the pressure side of the generally elongated blade proximate to the at least two pressure side impingement chambers, wherein at least one impingement orifice provides a cooling fluids pathway between the airfoil core cooling chamber and the pressure side mid-chord cooling channel;

a suction side mid-chord cooling channel formed from a plurality of elongated channels coupled together in series with impingement orifices and positioned between the inner and outer walls on the suction side of the generally elongated blade proximate to the at least two suction side impingement chambers, wherein at least one impingement orifice provides a cooling fluids pathway between the airfoil core cooling chamber and the pressure side mid-chord cooling channel; and a trailing edge cooling chamber formed from at least one cooling fluid supply chamber and at least one trailing edge impingement cooling chamber extending spanwise along the trailing edge and separated from the cooling fluid supply chamber by a rib containing at least one impingement orifice.

14. The turbine blade of claim 13, wherein the pressure side mid-chord cooling channel comprises at least three elongated cooling channels in series with each other, wherein each elongated cooling channel is separated by a rib containing at least one impingement orifice.

15. The turbine blade of claim 13, wherein the suction side mid-chord cooling channel comprises at least three elongated cooling channels in series with each other, wherein each elongated cooling channel is separated by a rib containing at least one impingement orifice.

16. The turbine blade of claim 13, wherein the trailing edge impingement cooling chamber comprises a plurality of trailing edge cooling chambers that extend spanwise along the trailing edge of the generally elongated blade and that are coupled together in series with at least one impingement orifice in ribs separating the trailing edge cooling chambers.

* * * * *